US009282604B2

(12) United States Patent
Lai et al.

(10) Patent No.: US 9,282,604 B2
(45) Date of Patent: Mar. 8, 2016

(54) NON-ISOLATED LED DRIVING CIRCUIT

(71) Applicant: Xi'An Quanxin Electronics Co., Xi'An (CN)

(72) Inventors: Xinquan Lai, Xi'An (CN); Jie Han, Xi'An (CN); Huisen He, Xi'An (CN); Lili Shao, Xi'An (CN)

(73) Assignee: Xi'An Quanxin Electronics Co., Xi'an (CN)

( * ) Notice: Subject to any disclaimer, the term of this patent is extended or adjusted under 35 U.S.C. 154(b) by 44 days.

(21) Appl. No.: 14/224,472

(22) Filed: Mar. 25, 2014

(65) Prior Publication Data

US 2015/0282262 A1 Oct. 1, 2015

(51) Int. Cl.
*H05B 37/02* (2006.01)
*H05B 33/08* (2006.01)

(52) U.S. Cl.
CPC ..... *H05B 33/0815* (2013.01); *H05B 37/02* (2013.01)

(58) Field of Classification Search
CPC ..... H05B 33/08; H05B 41/36; H05B 37/02
USPC ..... 315/209 R, 224–225, 246, 283, 287, 315/291, 294, 307, 360
See application file for complete search history.

(56) References Cited

U.S. PATENT DOCUMENTS

| | | | | |
|---|---|---|---|---|
| 7,598,685 | B1 * | 10/2009 | Shteynberg et al. | 315/308 |
| 7,804,256 | B2 * | 9/2010 | Melanson | 315/291 |
| 2010/0207536 | A1 * | 8/2010 | Burdalski et al. | 315/224 |
| 2011/0181198 | A1 * | 7/2011 | Iwai H05B | 33/0815 315/291 |
| 2011/0292704 | A1 * | 12/2011 | Makino et al. | 363/126 |

* cited by examiner

*Primary Examiner* — Tung X Le
(74) *Attorney, Agent, or Firm* — C. G. Mersereau; Nikolai & Mersereau, P.A.

(57) ABSTRACT

A non-isolated light-emitting diode (LED) driving circuit has a rectifier, a switching device, a sampling resistor, a power supply unit, a controller unit and a lighting unit. The controller unit samples a voltage at the sampling resistor to compare the sampling voltage with reference voltage to determine if the switching device is turned on or off. When the switching device is turned on, a charging current outputted from the rectifier charges the power supply unit and the power supply unit simultaneously discharges to supply power to the lighting unit. When the switching device is turned off, a discharging current outputted from the power supply unit supplies power to the lighting unit. As there are no transformer and electrolytic capacitor, the non-isolated LED driving circuit is simplified, durable and cost-effective.

8 Claims, 8 Drawing Sheets

NON-ISOLATED LED DRIVING CIRCUIT

BACKGROUND OF THE INVENTION

1. Field of the Invention

The present invention relates to a light-emitting diode (LED) driving circuit, and more particularly to a non-isolated LED driving circuit driving a switch device to control power supplied to the LEDs.

2. Description of the Related Art

Light-emitting diode (LED) is made of a compound including elements such as gallium (Ga), arsenic (As), phosphorus (P) and the like. Recombination of electrons and holes in the compound allows LED to radiate visible light. LED driving circuits have been widely used in products of consumer electronics and information technology, such as indoor and outdoor lighting, televisions and portable electronic devices. The LED driving circuits convert power supplied from an alternating current (AC) power source to direct current (DC) power. Additionally, LED driving circuits can also convert power from one voltage level to another voltage level.

The LED driving circuits can be classified into linear converters as well as switch-mode converters. The switch-mode converters are preferred over the linear converters because the switch-mode converters have higher efficiency than the linear converters, and, normally, power transistors, such as bipolar junction transistor (BJT), metal oxide semiconductor field effect transistors (MOSFET) and other types of transistors, are used as the power switches. The power switches generally receive pulse-frequency-modulated (PFM) and/or pulse-width-modulated (PWM) control signals from respective controllers.

With reference to FIG. 8, a conventional flyback LED driving circuit with a power switch includes a transformer 91, a controller unit 92, multiple LEDs 93, a power switch 94 and an electrolytic capacitor 95. The transformer 91 has a primary winding 911, a secondary winding 912 and an auxiliary winding 913. The power switch 94 is a field effect transistor, such as a high-voltage power MOSFET, and is used to control power delivered to the secondary winding 912 of the flyback LED driving circuit. For example, if the current of the primary winding 911 is greater than a threshold, the controller unit 92 turns off the power switch 94 and shuts down the flyback LED driving circuit.

As secondary-side feedback rules out the use of optocoupler and regulator in the LED driving circuit, the flyback LED driving circuit is thus complex in circuit design, making circuit miniaturization thereof hard to be achieved. Furthermore, instead of being directly used with a triac dimmer, the flyback LED driving circuit must have other circuits to function the same. Besides, the electrolytic capacitor 95 and the transformer 91 increase the cost and decrease the life time of the flyback LED driving circuit. Despite the LEDs 93 being a durable element, shorter life duration of the flyback LED driving circuit may arise from the electrolytic capacitor 95, which has a shorter life duration than other elements in the flyback LED driving circuit.

SUMMARY OF THE INVENTION

An objective of the present invention is to provide a non-isolated LED driving circuit driving a switch device to control power supplied to light-emitting diodes.

To achieve the foregoing objective, the non-isolated light-emitting diode (LED) driving circuit has a rectifier, a switching device, a sampling resistor, a power supply unit, a controller unit and a lighting unit.

The rectifier has two input terminals and two output terminals. The input terminals are adapted to respectively connect to a positive terminal and a negative terminal of an alternating current (AC) power source. One of the output terminals is connected to the ground.

The switching device has a first terminal, a second terminal and a control terminal. The first terminal is connected to the other output terminal of the rectifier.

The sampling resistor has a first end and a second end. The first end is connected to the second terminal of the switching device. The second end is connected to the ground.

The power supply unit has two input terminals and two output terminals. The input terminals are respectively connected to the first end and the second end of the sampling resistor. The input terminal connected to the first end of the sampling resistor is connected to the second terminal of the switching device.

The controller unit has an input terminal and an output terminal. The input terminal is connected to the first end of the sampling resistor for receiving a sampling voltage at the first end of the sampling resistor. The output terminal is connected to the control terminal of the switching device for the controller unit to turn on or turn off the switching device according to the sampling voltage.

The lighting unit is connected to the two output terminals of the power supply unit for the power supply unit to supply an operating power to the lighting unit.

The non-isolated LED driving circuit turns on or turn off the switching device to supply a charging current outputted from the rectifier to the power supply unit and the power supply unit simultaneously discharges to supply power to the lighting unit or to supply a discharging current outputted from the power supply unit to the lighting unit. Additionally, as having two operation modes, a constant peak current mode and a constant turn-on time mode, the non-isolated LED driving circuit can lower the EMI during the constant peak current mode while increasing the power factor thereof during the constant turn-on time mode. Accordingly, the non-isolated LED driving circuit is simplified and miniaturized in circuit design, durable in life cycle, and cost-effective for getting rid of transformer and electrolytic capacitor and delivering enhanced performance in operation.

Other objectives, advantages and novel features of the invention will become more apparent from the following detailed description when taken in conjunction with the accompanying drawings.

DETAILED DESCRIPTION OF THE INVENTION

The present invention is directed to the integrated circuits. More particularly the invention provides a system and method for driving switch device. Merely by way of example, the invention has been applied to the power converter. But it would be recognized that the invention has a much broader range of applicability. For example, the present invention can be applied to the driving circuit of light emitting diodes (LEDs).

Figure 1:
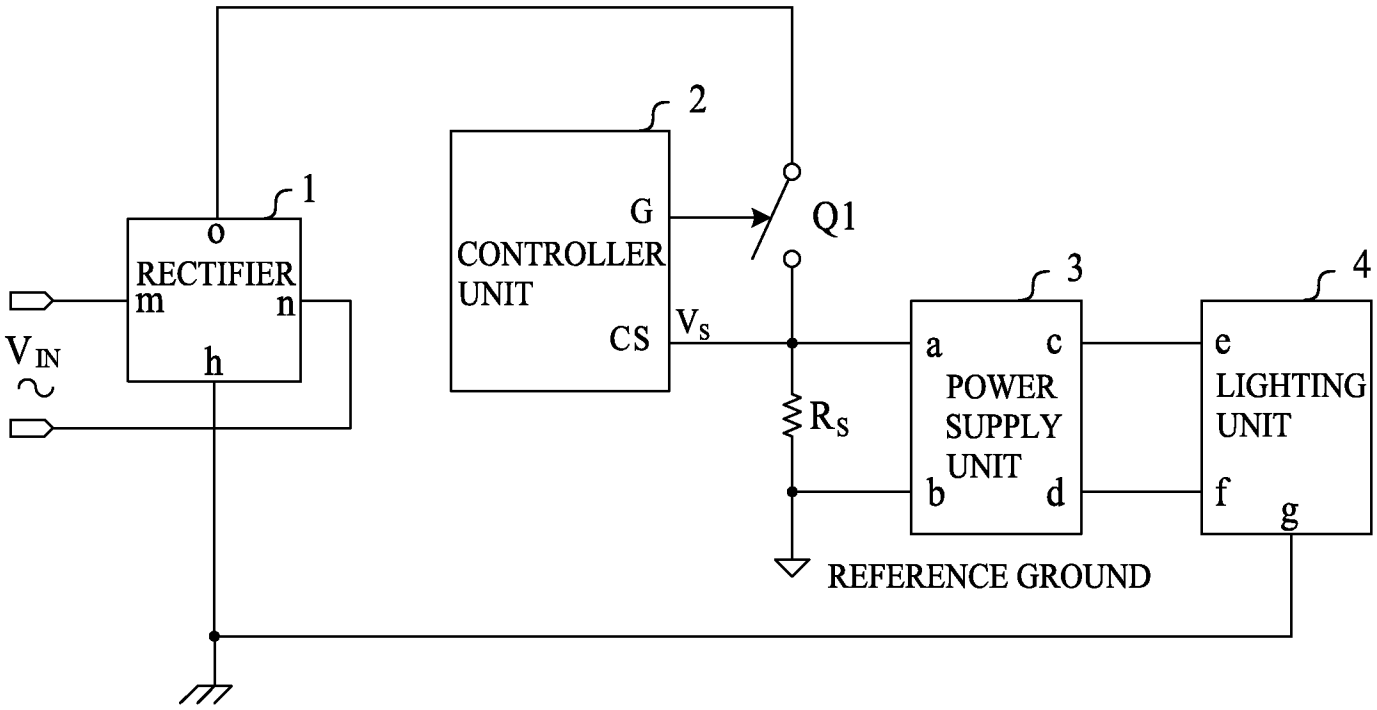
FIG. 1 is a functional circuit diagram of a non-isolated LED driving circuit in accordance with the present invention.

With reference to FIG. 1, a general circuit layout of a non-isolated LED driving circuit in accordance with the present invention includes a rectifier 1, a switching device Q1, a sampling resistor Rs, a power supply unit 3, a controller unit 2 and a lighting unit 4.

The rectifier 1 has two input terminals (m, n) and two output terminals (o, h). The two input terminals (m, n) are respectively connected to a positive terminal and a negative terminal of the AC voltage $V_{IN}$. One of the output terminals (h) of the rectifier 1 is connected to the ground.

The switching device Q1 has a first terminal, a second terminal and a control terminal. The first terminal is connected to the other output terminal (o) of the rectifier 1. The switching device Q1 may be a field effect transistor (FET) or a bipolar junction transistor (BJT).

The sampling resistor Rs has a first end and a second end. The second end is connected to the ground.

The power supply unit 3 has two input terminals (a, b) and two output terminals (c, d). The input terminals (a, b) of the power supply unit 3 are respectively connected to the first end and the second end of the sampling resistor Rs. The input terminal (a) connected to the first end of the sampling resistor Rs is connected to the second terminal of the switching device Q1. The second terminal of the switching device is connected to the first end of the sampling resistor Rs and one of the input terminals (a) of the power supply unit. The other input terminal of the power supply unit 3 is also connected to a reference ground. The power supply unit 3 serves to provide operating voltage and current to the lighting unit 4.

The controller unit 2 has an input terminal CS and an output terminal G. The input terminal CS of the controller unit 2 is connected to the first end of the sampling resistor Rs. The output terminal G of the controller unit 2 is connected to the control terminal of the switching device Q1. A sampling voltage Vs at the first end of the sampling resistor Rs is sampled. The input terminal CS of the controller unit 2 receives the sampling voltage Vs for the controller unit 2 to turn on or turn off the switching device Q1 according to the sampling voltage.

The lighting unit 4 includes two input terminals (e, f), a ground terminal (g) and at least one LED. The at least one LED may be connected in series, in parallel, or in series and parallel, across the output terminals (c, d) of the power supply unit 3. The input terminals (e, f) of the lighting unit 4 are respectively connected to the output terminals (c, d) of the power supply unit 3. The ground terminal is connected to the ground.

Figure 2:
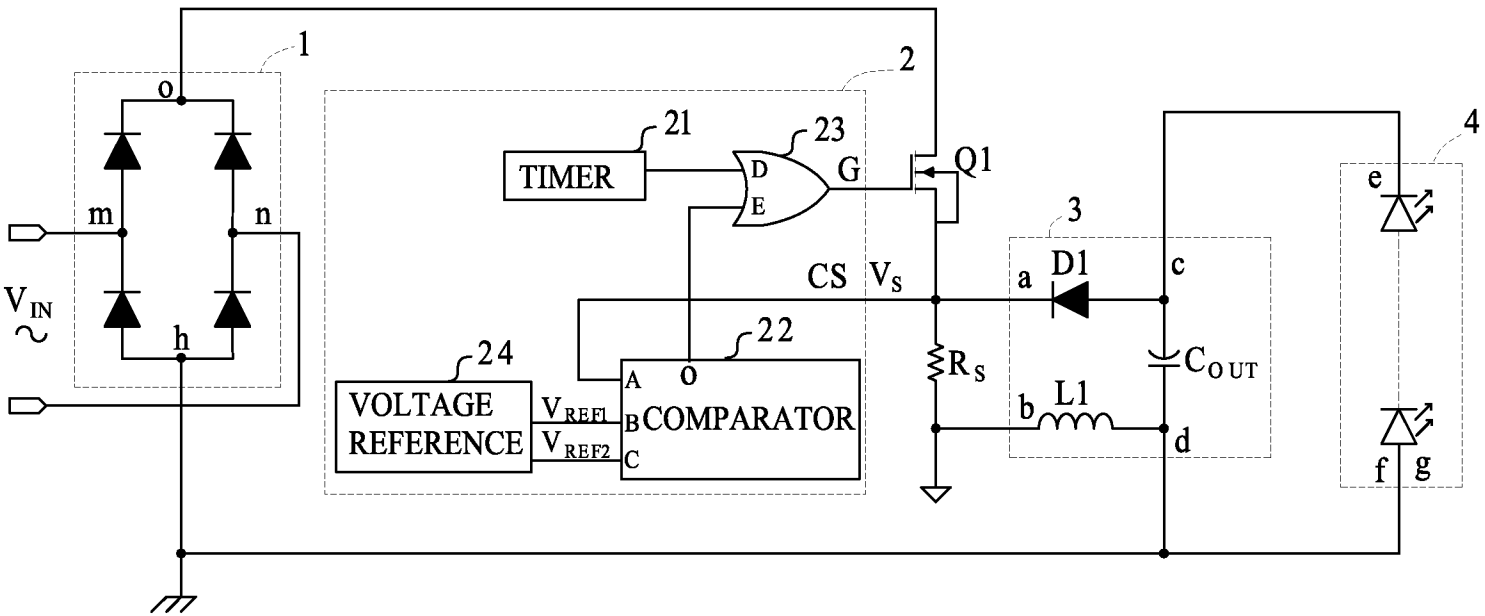
FIG. 2 is a circuit diagram of a first embodiment of the non-isolated LED driving circuit in FIG. 1.

With reference to FIG. 2, a first embodiment of a non-isolated LED driving circuit in accordance with the present invention is shown. In the present embodiment, the switching device Q1 is a N-MOSFET, the controller unit 2 of the non-isolated LED driving circuit includes a timer 21, a voltage reference 24, an OR gate 23 and a comparator 22, and the power supply unit 3 has an inductor L1 and a diode D1.

The drain of the N-MOSFET is connected to the ungrounded output terminal (o) of the rectifier 1. The drain of the N-MOSFET is further connected to the input terminal (a) of the power supply unit 3 connected to the first end of the sampling resistor Rs and is connected to the reference ground through the sampling resistor Rs. The drain of the N-MOSFET is biased to a first predetermined voltage that is an output voltage from the ungrounded output terminal (o) of the rectifier 1. Furthermore, the source of the N-MOSFET is connected to the first end of the sampling resistor Rs, and the second end of the sampling resistor Rs is connected to a second predetermined voltage. The second predetermined voltage is the voltage at the reference ground. The first predetermined voltage is higher than the second predetermined voltage. The voltage measured at the first end of the sampling resistor Rs is a sampling voltage Vs.

A traditional band gap structure is used in the voltage reference 24 to generate a first reference voltage $V_{REF1}$ and a second reference voltage $V_{REF2}$ with zero temperature coefficients. The first reference voltage $V_{REF1}$ is greater than the second reference voltage $V_{REF2}$.

The OR gate 23 has a first input terminal D, a second input terminal E, and an output terminal G. The output terminal G of the OR gate 23 is connected to the output terminal G of the controller unit 2 and is further connected to the gate of the N-MOSFET to turn on or turn off the N-MOSFET.

The timer 21 has an output terminal connected to the first input terminal D of the OR gate 23. The timer 21 counts a turn-on time of the N-MOSFET, compares if the turn-on time of the N-MOSFET is greater than a turn-on time threshold $T_{ON}$ set by the timer 21, and outputs a low level signal to the OR gate when the comparison result is positive to turn off the N-MOSFET, or sends a high level signal to the OR gate when the comparison result is negative to turn on the N-MOSFET. The timer 21 also counts a turn-off time of the N-MOSFET, compares if the turn-off time of the N-MOSFET is greater than a turn-on time threshold $T_{OFF}$ set by the timer 21, and outputs a high level signal to the OR gate when the comparison result is positive to turn on the N-MOSFET, or sends a low level signal to the OR gate when the comparison result is negative to turn off the N-MOSFET.

The comparator 22 has a first input terminal A, a second input terminal B, a third input terminal C, and an output terminal O. The first input terminal A is connected to the input terminal CS of the controller unit 2. The second input terminal B is connected to the first reference voltage $V_{REF1}$. The third input terminal C is connected to the second reference voltage $V_{REF2}$. The output terminal O of the comparator is connected to the second input terminal E of the OR gate 23. The N-MOSFET is turned on or turned off by comparing the sampling voltage Vs with the first reference voltage $V_{REF1}$ and the second reference voltage $V_{REF2}$. The comparator 22 determines if the sampling voltage Vs is greater than the first reference voltage $V_{REF1}$. The comparator 22 outputs a low level signal to the OR gate 23 when the determination result is positive, and outputs a high level signal to the OR gate 23 when the determination result is negative. The comparator 22 also determines if the sampling voltage Vs is greater than the second reference voltage $V_{REF2}$. The comparator 22 outputs a low level signal to the OR gate 23 when the determination result is positive, and outputs a high level signal to the OR gate 23 when the determination result is negative.

The diode D1 of the power supply unit 3 has a positive terminal and a negative terminal. The positive terminal is connected to one of the output terminals (c) of the power supply unit 3. The negative terminal of the diode D1 is connected to one of the input terminals (a) connected to the first end of the sampling resistor Rs. One end of the inductor L1 of the power supply unit 3 is connected to the positive terminal of the diode through a capacitor Cout. The other end of the inductor L1 is connected to the second end of the sampling resistor Rs. A common terminal of the capacitor Cout is connected to the positive terminal of the diode D1. The inductor L1 and a common terminal of the capacitor Cout are taken as the other output terminal (d) of the power supply unit 3.

The lighting unit 4 has multiple LEDs connected in series to each other. The positive terminal of a heading one of the LEDs connected to one of the input terminal (f) and the ground terminal of the lighting unit 4 is connected to one of the output terminals (d) of the power supply unit 3. The negative terminal of a trailing one of the LEDs is connected to the other output terminal (c) of the power supply unit 3. Either one of the positive terminal and the negative terminal of any one of the LEDs can be taken as the ground terminal of the lighting unit 4. In the present embodiment, the positive terminal of the heading LED is taken as the ground terminal of the lighting unit 4.

Operation of the present embodiment is described as follows.

Figure 3:
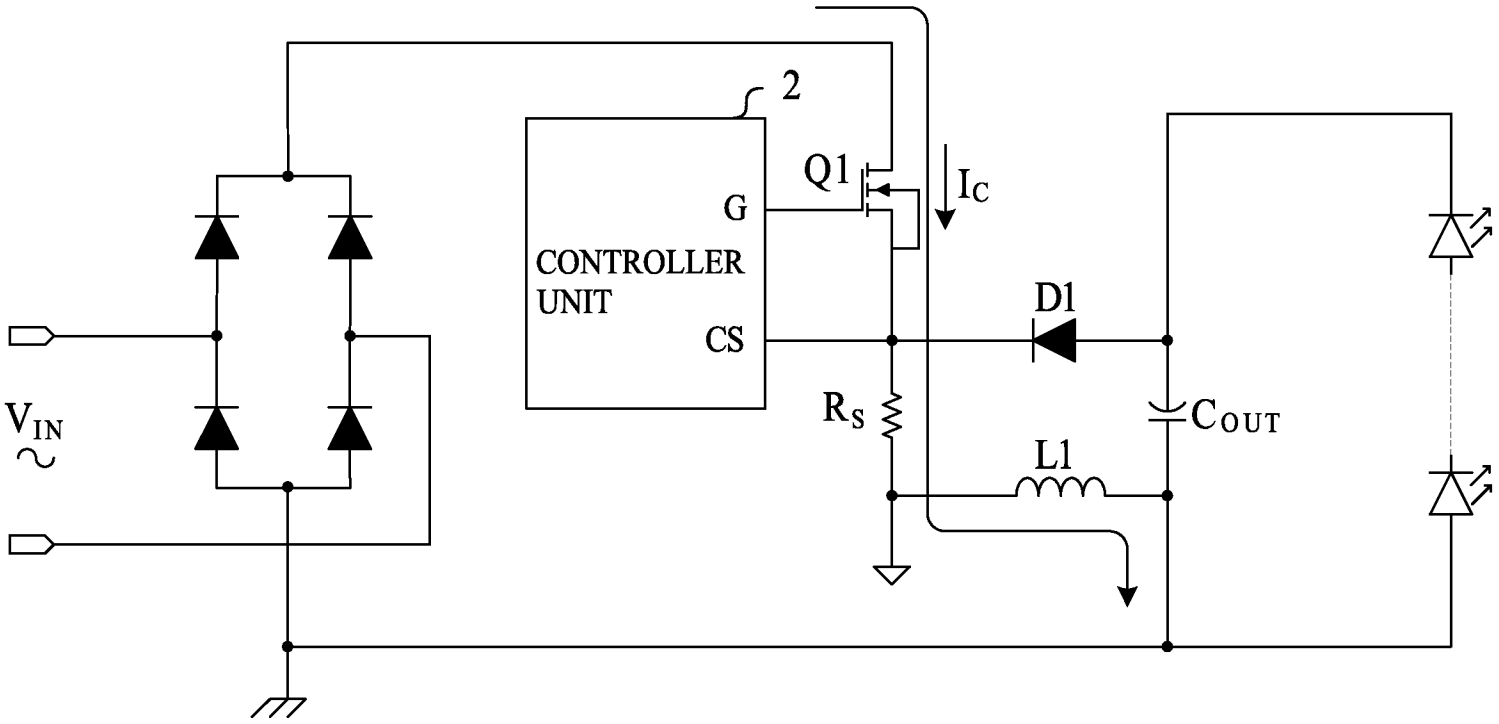
FIG. 3 is an operational circuit diagram of the non-isolated LED driving circuit in FIG. 2.

With reference to FIGS. 2 and 3, when the voltage level of the output voltage of the rectifier 1 is logic high, the N-MOSFET is turned on. After the N-MOSFET is turned on and operated in the linear region, a charging current $I_C$ flows from the ungrounded output terminal of the rectifier 1 to the grounded output terminal of the rectifier 1 through the N-MOSFET, the sampling resistor Rs and the inductor L1 to charge the inductor L1. Meanwhile, the diode D1 is not turned on, and the capacitor Cout supplies power to the lighting unit 4. The charging current $I_C$ ramps up to charge the inductor L1 and can be expressed by the following equation.

$$I_C = \frac{|V_{IN}| \cdot \left(1 - e^{-t' \cdot (Rdsm + R_S)/L_1}\right)}{Rdsm + R_S} \quad \text{(Equation 1)}$$

where $|V_{IN}|$ represents the output voltage of the rectifier 1, t' represents an actual turn-on time of the N-MOSFET, $L_1$ represents the inductance of the inductor L1, Rdsm is a turn-on resistance of the N-MOSFET, and Rs is resistance of the sampling resistor Rs. As the voltage drop across the N-MOSFET and the sampling resistor is much smaller than the voltage drop across the inductor L1, Equation 1 can be further simplified as follows.

$$I_C = \frac{|V_{IN}| \cdot t'}{L_1} \quad \text{(Equation 2)}$$

It is noted that the charging current $I_C$ is proportional to the product of the turn-on time t' of the N-MOSFET and the output voltage $|V_{IN}|$ of the rectifier 1. In other words, the charging current $I_C$ increases with the turn-on time t' of the N-MOSFET because the output voltage $|V_{IN}|$ is stable and can be treated as a constant. As the charging current $I_C$ increases with the turn-on time t' of the N-MOSFET, the voltages at the first end and the second end of the sampling resistor Rs also keep increasing. In other words, the sampling voltage Vs keeps increasing. When the sampling voltage Vs is greater than the first reference voltage $V_{REF1}$ or the turn-on time of the N-MOSFET reaches the turn-on time threshold $T_{ON}$, the timer 21 is reset and the OR gate 23 deactivates the gate of the N-MOSFET such that the N-MOSFET is turned off.

Figure 4:
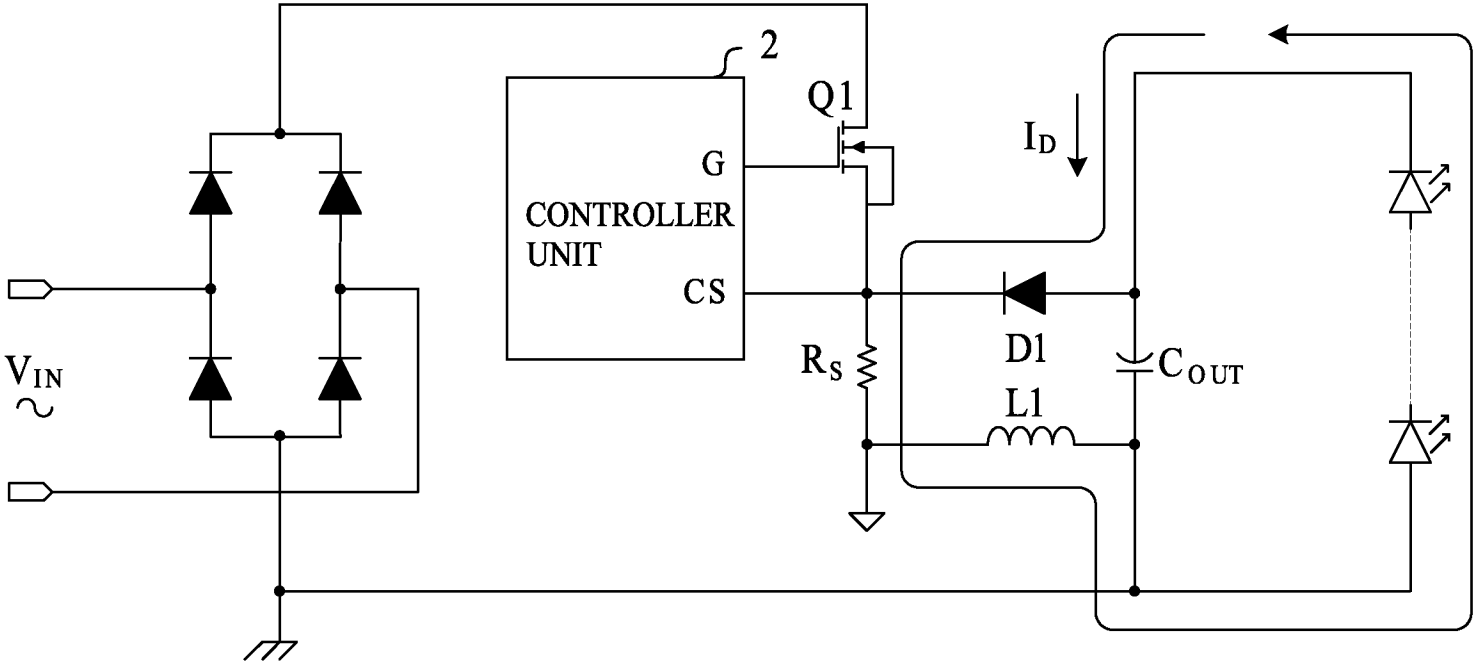
FIG. 4 is an operational circuit diagram of the non-isolated LED driving circuit in FIG. 2.

With reference to FIGS. 2 and 4, when the NMOSFET is turned off, the charging current $I_C$ becomes zero and the inductor L1 supplies power to the lighting unit 4. A discharging current $I_D$ is discharged from the inductor L1 to charge the capacitor Cout and supplies power to the lighting unit 4. The discharging current $I_D$ can be expressed by the following equation:

$$I_D = \frac{(I_{pkc} R_S + V_d + V_{out}) \cdot e^{-t'' \cdot R_S/L_1} - (V_d + V_{out})}{R_S} \quad \text{(Equation 3)}$$

where $V_{out}$ represents a constant output voltage across the lighting unit 4, $V_d$ represents the voltage across the diode D1, t" represents a turn-off time of the N-MOSFET, and $L_1$ represents the inductance of the inductor, $I_{pkc}$ is the peak value of the discharging current, and $R_S$ is the resistance of the sampling resistor Rs.

Equation 3 can be further simplified as follows.

$$I_{pkc} = \frac{V_{REF1}}{R_S} \quad \text{(Equation 4)}$$

where $V_{REF1}$ represents the first reference voltage of the voltage reference 24.

As the discharging current of the inductor L1 gradually decreases from the peak value of the discharging current, $I_{pkc}$ with the turn-off time t", the voltages at the first end and the second end of the sampling resistor also keep decreasing. In other words, the sampling voltage Vs keeps decreasing. When the sampling voltage Vs is less than the second reference voltage $V_{REF2}$ or when the turn-off time of the N-MOSFET reaches the turn-off time threshold $T_{OFF}$, the timer 21 starts counting the turn-on time of the N-MOSFET and the OR gate 23 activates the gate of the N-MOSFET such that the N-MOSFET is turned on.

Figure 5:
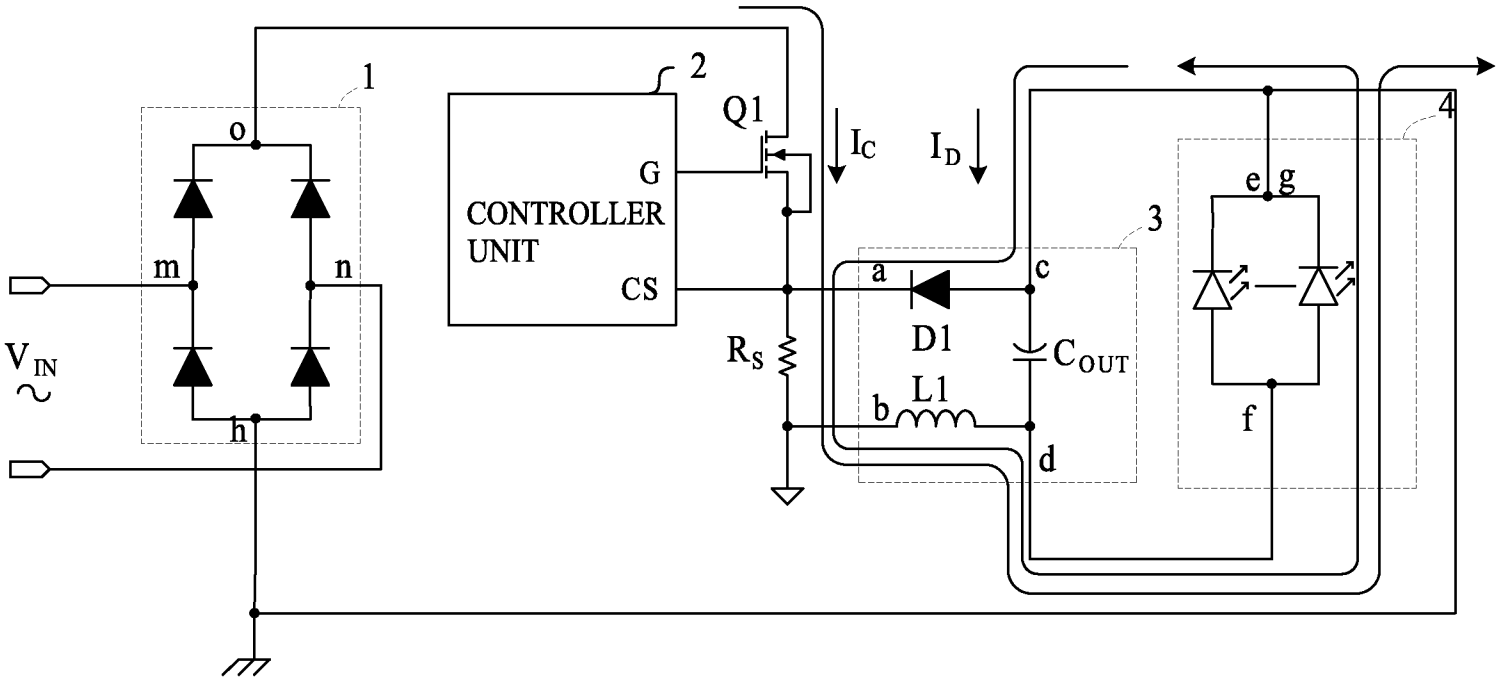
FIG. 5 is a circuit diagram of a second embodiment of the non-isolated LED driving circuit in FIG. 1.
Figure 6:
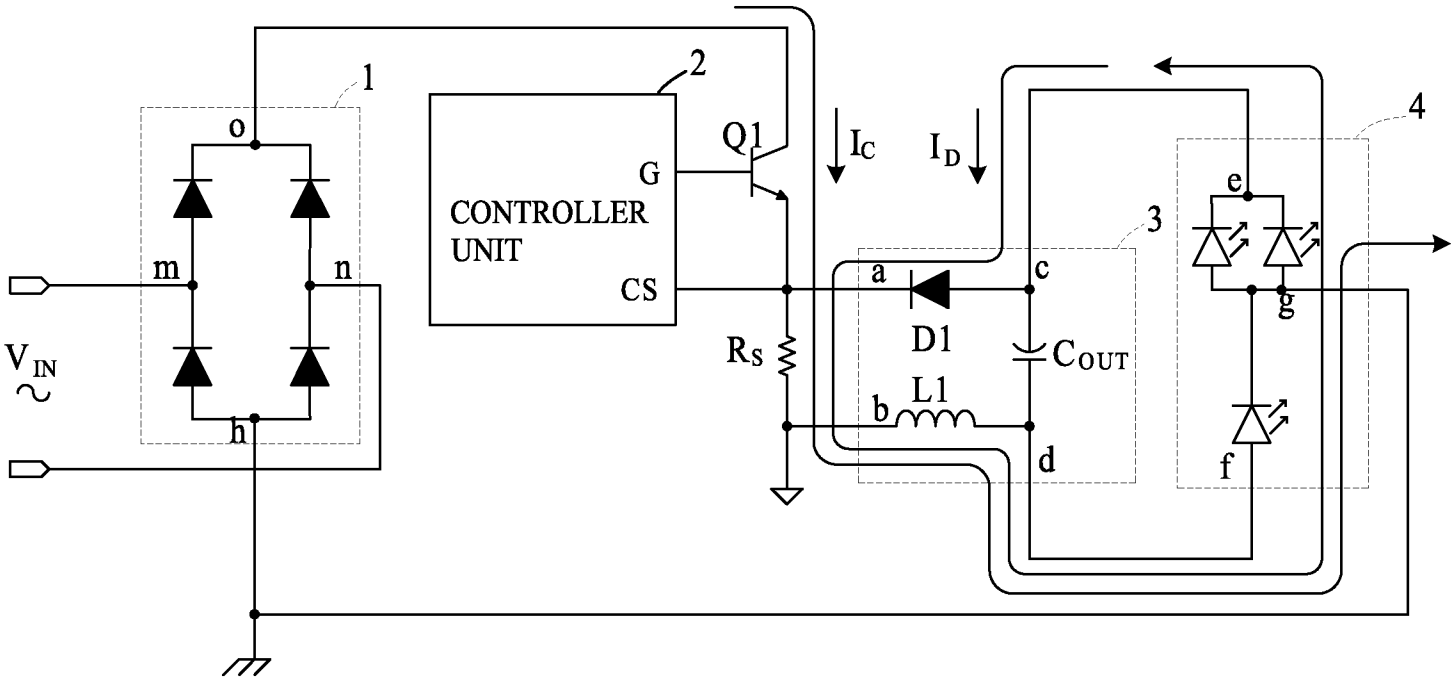
FIG. 6 is a circuit diagram of a third embodiment of the non-isolated LED driving circuit in FIG. 1.

With reference to FIGS. 5 and 6, a second embodiment and a third embodiment of a non-isolated LED driving circuit in accordance with the present invention differ from the first embodiment in that the multiple LEDs in the lighting unit 4 are parallelly connected in FIG. 5 and the multiple LEDs in the lighting unit 4 are connected in series and in parallel in FIG. 6. Operation of the second embodiment and the third embodiment is similar to the operation of the first embodiment.

Figure 7:
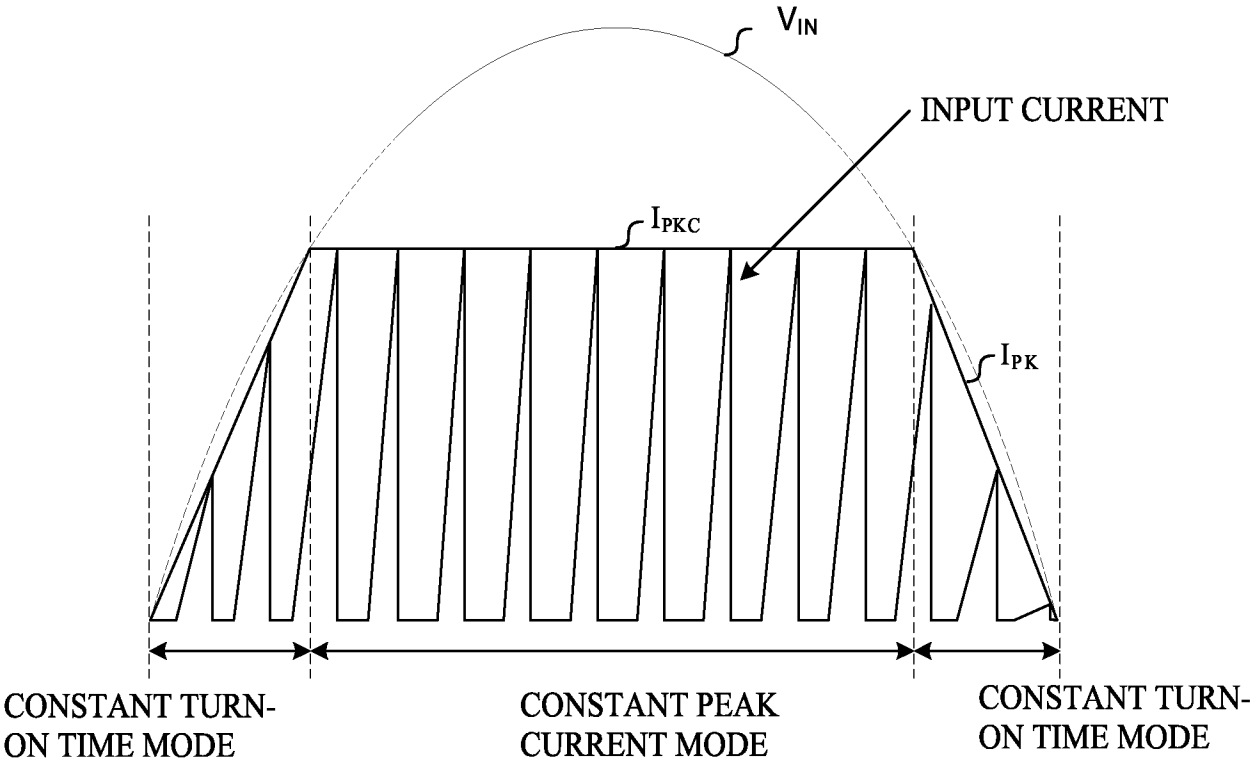
FIG. 7 is a waveform diagram showing voltage and current of an external AC input into a rectifier of the non-isolated LED driving circuit in one cycle.
Figure 8:
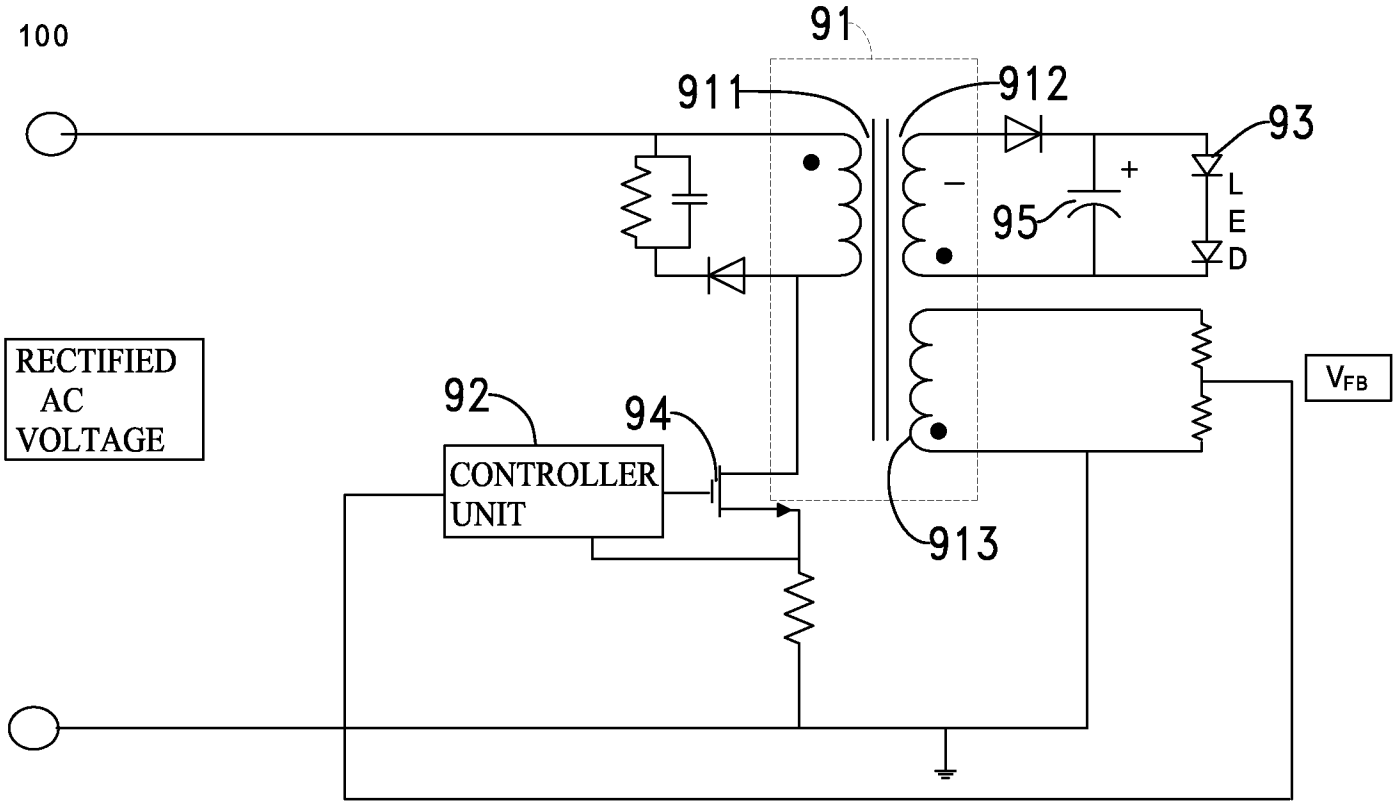
FIG. 8 PRIOR ART
FIG. 8 is a circuit diagram of a conventional flyback LED driving circuit with a power switch.

With reference to FIG. 7, the non-isolated LED driving circuit is operated under a constant peak current mode and a constant turn-on time mode. When the output voltage of the rectifier is below or equal to the average input voltage, the non-isolated LED driving circuit is operated under the constant turn-on time mode. When the output voltage of the rectifier is above the average input voltage, the non-isolated LED driving circuit is operated under the constant peak current mode.

During the constant peak current mode, the constant peak current $I_{PKC}$ is expressed as in Equation 4 and an input power P is expressed as follows:

$$P = \frac{1}{2} \cdot I_{pkc} \cdot \frac{V_{OUT} \cdot V_{AVE}}{V_{OUT} + V_{AVE}} \quad \text{(Equation 5)}$$

where $V_{OUT}$ represents a voltage difference between the two input terminals (e, f) of the lighting unit 4 and $V_{AVE}$ represents an average input voltage.

As the lighting unit 4 is composed of LEDs, according to the operational characteristics of LED, the $V_{OUT}$ to the lighting unit 4 almost remains a constant. The $V_{AVE}$ is also kept as a constant. Accordingly, the input power P is proportional to the constant peak current $I_{PKC}$.

When the switching device Q1 is turned on, the turn-on time of the switching device Q1 can be expressed as follows:

$$T_{ON} = \frac{L \cdot I_{PKC}}{V_{IN}} \quad \text{(Equation 6)}$$

where L is the inductance of the inductor L1, and $V_{IN}$ represents the output voltage of the rectifier 1.

When the switching device Q1 is turned off, the turn-off time of the switching device Q1 can be expressed as follows:

$$T_{OFF} = \frac{L \cdot I_{PKC}}{V_{OUT}} \quad \text{(Equation 7)}$$

A cycle T of the switching device Q1 can be expressed as follows:

$$T = T_{ON} + T_{OFF} \quad \text{(Equation 8)}$$

A frequency f of the switching device Q1 is equal to 1/T. As the output voltage $V_{IN}$ of the rectifier 1 continuously varies in each cycle of the AC input power, the frequency f also continuously varies in each cycle of the AC input power, thereby facilitating EMI (Electromagnetic interference) reduction.

During the constant turn-on time mode, a constant turn-on time is defined as $T_{ONC}$. According to Equation 6, a peak current $I_{PK}$ at the constant turn-on mode can be obtained as follows:

$$I_{PK} = \frac{T_{ONC} \cdot V_{AC}}{L} \quad \text{(Equation 9)}$$

where $V_{AC}$ is the AC input voltage.

As the peak current $I_{PK}$ is proportional to $V_{IN}$, a power factor of the non-isolated LED driving circuit is effectively increased.

In sum, given a switching device, a sampling resistor, a power supply unit and the controller unit, the non-isolated LED driving circuit can turn on the switching device for a charging current outputted from the rectifier to charge the power supply unit and the power supply unit simultaneously discharges to supply power to the lighting unit, and the non-isolated LED driving circuit can turn off the switching device for a discharging current outputted from the power supply unit to supply power to the lighting unit. Without transformer and electrolytic capacitor as in an isolated LED driving circuit, the non-isolated LED driving circuit is simplified, durable and cost-effective. Additionally, due to the feasibility of being operated under a constant peak current mode when the output voltage of the rectifier is more than the average input voltage and under a constant turn-on time mode when the output voltage of the rectifier is less than or equal to the average input voltage, the non-isolated LED driving circuit lowers the EMI during the constant peak current mode while increasing the power factor during the constant turn-on time mode.

Even though numerous characteristics and advantages of the present invention have been set forth in the foregoing description, together with details of the structure and function of the invention, the disclosure is illustrative only. Changes may be made in detail, especially in matters of shape, size, and arrangement of parts within the principles of the invention to the full extent indicated by the broad general meaning of the terms in which the appended claims are expressed.

What is claimed is:

1. A non-isolated light-emitting diode (LED) driving circuit, comprising:

a rectifier having:

two input terminals adapted to respectively connect to a positive terminal and a negative terminal of an alternating current (AC) power source; and two output terminals, one of the output terminals connected to the ground;

a switching device having:

a first terminal connected to the other output terminal of the rectifier;

a second terminal; and a control terminal;

a sampling resistor having:

a first end connected to the second terminal of the switching device; and a second end connected to the ground;

a power supply unit having:

two input terminals respectively connected to the first end and the second end of the sampling resistor, wherein the input terminal connected to the first end of the sampling resistor is connected to the second terminal of the switching device; and two output terminals;

a controller unit having:

an input terminal connected to the first end of the sampling resistor for receiving a sampling voltage at the first end of the sampling resistor;

an output terminal connected to the control terminal of the switching device;

a reference voltage generating a first reference voltage and a second reference voltage with zero temperature coefficients, wherein the first reference voltage is greater than the second reference voltage;

an OR gate having:

a first input terminal;

a second input terminal; and an output terminal connected to the output terminal of the controller unit and the control terminal of the switching device to turn on or turn off the switching device according to the sampling voltage;

a timer having an output terminal connected to the first input terminal of the OR gate, counting a turn-on time of the switching device, comparing if the turn-on time of the switching device is greater than a turn-on time threshold set by the timer, and outputting a low level signal to the OR gate to turn off the switching device when the comparison result is positive or outputting a high level signal to the OR gate to turn on the switching device when the comparison result is negative; and a comparator having:

a first input terminal connected to the input terminal of the controller unit;

a second input terminal connected to the first reference voltage;

a third input terminal connected to the second reference voltage; and an output terminal connected to the second input terminal of the OR gate;

wherein the comparator determines if the sampling voltage is greater than the first reference voltage, and outputs a low level signal to the OR gate to turn off the switching device when the determination result is positive and a high level signal to the OR gate to turn on the switching device when the determination result is negative, the comparator also determines if the sampling voltage is greater than the second reference voltage, and output a low level signal to the OR gate to turn off the switching device when the sampling voltage is greater than the second reference voltage and a high level signal to the OR gate to turn on the switching device when the sampling voltage is not greater than the second reference voltage; and a lighting unit connected to the two output terminals of the power supply unit for the power supply unit to supply an operating power to the lighting unit.

2. The non-isolated LED driving circuit as claimed in claim 1, wherein the power supply unit has:

a diode having:

a positive terminal connected to one of the output terminals of the power supply unit; and a negative terminal connected to the input terminal that is connected to the first end of the sampling resistor;

a capacitor having a common terminal connected to the positive terminal of the diode; and an inductor having two ends, wherein one end of the inductor is connected to the positive terminal of the diode through the capacitor, and the other end of the inductor is connected to the second end of the sampling resistor.

3. The non-isolated LED driving circuit as claimed in claim 2, wherein the lighting unit has at least one LED connected in series, in parallel, or in series and in parallel between the two output terminals of the power supply unit, and a positive terminal or a negative terminal of any one of the at least one LED is connected to the ground.

4. The non-isolated LED driving circuit as claimed in claim 3, wherein the switching device is a FET or a BJT.

5. The non-isolated LED driving circuit as claimed in claim 2, wherein the switching device is a FET or a BJT.

6. The non-isolated LED driving circuit as claimed in claim 1, wherein the lighting unit has at least one LED connected in series, in parallel, or in series and in parallel between the two output terminals of the power supply unit, and a positive terminal or a negative terminal of any one of the at least one LED is connected to the ground.

7. The non-isolated LED driving circuit as claimed in claim 6, wherein the switching device is a FET or a BJT.

8. The non-isolated LED driving circuit as claimed in claim 1, wherein the switching device is a field effect transistor (FET) or a bipolar junction transistor (BJT).

* * * * *